US005851139A

United States Patent [19]

Xu

[11] Patent Number: 5,851,139

[45] Date of Patent: Dec. 22, 1998

[54] CUTTING HEAD FOR A WATER JET CUTTING ASSEMBLY

[75] Inventor: Jian Xu, Plymouth, Minn.

[73] Assignee: Jet Edge Division of TC/American Monorail, Inc., Minneapolis, Minn.

[21] Appl. No.: 794,815

[22] Filed: Feb. 4, 1997

[51] Int. Cl.[6] ..... B24C 5/04; B05B 7/04

[52] U.S. Cl. ..... 451/102; 239/433; 451/90

[58] Field of Search ..... 83/53, 177; 239/310, 239/318, 336, 340, 433, 434, 600, DIG. 8; 451/90, 102

[56] References Cited

U.S. PATENT DOCUMENTS

| | | |
|---|---|---|
| Re. 23,064 | 12/1948 | Tirrell . |
| 1,988,432 | 1/1935 | Gillett et al. . |
| 3,770,209 | 11/1973 | Wilcox . |
| 4,545,157 | 10/1985 | Saurwein . |
| 4,555,872 | 12/1985 | Yie . |
| 4,648,215 | 3/1987 | Hashish et al. . |
| 4,666,083 | 5/1987 | Yie . |
| 4,817,874 | 4/1989 | Jarzebowicz . |
| 4,836,455 | 6/1989 | Munoz . |
| 4,848,671 | 7/1989 | Saurwein . |
| 4,872,615 | 10/1989 | Myers . |
| 5,018,670 | 5/1991 | Chalmers . |
| 5,144,766 | 9/1992 | Hashish et al. . |
| 5,155,946 | 10/1992 | Domann . |
| 5,209,406 | 5/1993 | Johnson . |
| 5,456,629 | 10/1995 | Bingham . |

*Primary Examiner*—Timothy V. Eley
*Attorney, Agent, or Firm*—Haugen and Nikolai, P.A.

[57] ABSTRACT

An improved cutting head for a water jet cutting assembly utilizing water or other liquid medium at ultra high pressure, with the cutting head including an assembly with an elongated body having a central bore along its axis and including a delivery nozzle at the distal end of the assembly. Alignment of the components is maintained by incorporating a process of manufacture which utilizes the formation of a single bore extending through the body so as to both form and maintain axial alignment of the components. The arrangement is further characterized by having mating surfaces which are free of gaskets or other packing material, thereby establishing, maintaining, and preserving proper axial alignment of components.

5 Claims, 2 Drawing Sheets

CUTTING HEAD FOR A WATER JET CUTTING ASSEMBLY

FIELD OF THE INVENTION

The present invention relates generally to an improved system for fluid jet cutting machines having cutting heads for producing a high velocity fluid jet for penetrating and cutting through a workpiece. More specifically, the present invention relates to such a cutting head having means for introducing an abrasive particulate material into the flow, and additionally is configured in a manner permitting ease of assembly and alignment of the flow channel as it extends through the cutting head, including that portion of the flow passing through the abrasive mixing chamber.

Water jet cutting machines are widely used for operation in cutting and/or forming patterns in metallic, glass, ceramic, and other materials. Water jet cutting systems and machines have particular utility in connection with articles fabricated or formed of materials having brittle or poor mechanical properties. Additionally, water jet cutting systems have been found highly useful in connection with the formation of intricate or complex patterns without the creation of burrs or other anomalies requiring post-cutting treatment. As such, water jet cutting systems are highly useful in a wide variety of applications.

In connection with the cutting head portion of the system, a number of such devices have been known in the past. Among these are that device disclosed in Chalmers U.S. Pat. No. 5,018,670, commonly assigned, and the substance of which patent is hereby incorporated by reference.

In order to facilitate ease of assembly and alignment of the cutting head, the present invention is provided with components having configurations which simplify alignment of the components of the flow channel through the cutting head, and furthermore simplify the formation of seals between mating surfaces of individual components.

With the system of the present invention, a cutting head is provided which creates a water jet into which a suspension of abrasive particulate material has been introduced. Introduction of abrasive materials increases the rate at which workpieces may be cut and finished. For example, fluid jet cutting systems employ pumps characterized as intensifiers which increase the pressure of water in the system to the ultra-high level, such as in the range of 60,000 psi. This high pressure water is forced through a jewel nozzle having a small orifice therein in order to generate a jet flow of high velocity. The abrasive materials are added to the flow downstream from the orifice in a mixing chamber, at which point the abrasive material is entrained into the flow stream of the water jet. Upon leaving the mixing chamber, the flow stream enters and passes through a nozzle from which the abrasive-ladened flow exits the system. The nozzle assists in directing the jet along its path toward the workpiece.

In order to extend the lifetime of the individual components, it is essential that the components through which the flow forming the water jet passes be in proper axial alignment. Component misalignment can result in damage to the bores, and such damage is typically immediate and extensive. Accordingly, it is important that alignment be facilitated and maintained.

The formation of seals between mating surfaces of components is also of importance. In the past, various added components are utilized to create seals. In the present invention, however, mating surfaces are provided which are machined to an appropriate tolerance so that the surfaces are capable of withstanding the forces imposed by the ultra high pressure water, and hence seals are formed without the necessity of added components such as "O"-rings and the like.

In order to create the initial alignment which is readily maintained, the body of the cutting head is bored axially from end-to-end, specifically from the inlet end to the outlet end. A counterbore is formed adjacent the inlet end, with the base of the counterbore forming a shoulder surface. This shoulder surface assists in aligning a jeweled seat assembly therewithin, and the presence of the elongated bore through the body assures appropriate alignment of the components along the axis of the bore so formed.

SUMMARY OF THE INVENTION

In accordance with the present invention, a cutting head is provided for a water jet cutting system or assembly, with the cutting head comprising an elongated body having an axially extending main bore therethrough, along with a counterbore extending through a portion of the length of the elongated body. An inlet is adjacent one end of the counterbore, with an outlet being provided at the opposed end of the body. A mixing chamber is interposed between the inlet and outlet ends, and a jeweled seat assembly is mounted on the shoulder formed at the base of the counterbore. The jeweled seat assembly comprises a cylindrical body with a flanged head, and having a bore extending therethrough. A jewel receiving cavity is formed in the head of the jeweled seat assembly, with the underside of the head of the jewel seat assembly forming a seal with the base of the counterbore. The flow channel is formed by the jewel, and extends through the body, passing through the mixing chamber from which abrasive particulate may be introduced into the flow. A nozzle is mounted within the bore of the body, with the nozzle having a flow receiving bore arranged coaxially therewithin, with the nozzle being ultimately retained within the bore formed through the body. In this arrangement, therefore, the individual components are assembled in such a way that effective seals are provided along mating surfaces, and furthermore the fabrication techniques employed facilitate ease of both initial alignment and means for retaining alignment of components forming the flow channel formed by the jeweled orifice and extending through the entire assembly including the nozzle discharge tip.

Therefore, it is a primary object of the present invention to provide an improved water jet cutting head having components formed and configured in a fashion which facilitates ease of alignment during assembly, and with the alignment being effectively retained.

It is a further object of the present invention to provide an improved water jet cutting head having components designed and configured to preserve axial alignment over extended periods of time, with the cutting head being further provided with a mixing chamber permitting the effective introduction of abrasive particulate into the flow.

Other and further objects of the present invention will become apparent to those skilled in the art upon a study of the following specification, appended claims, and accompanying drawings.

IN THE DRAWINGS

DESCRIPTION OF THE PREFERRED EMBODIMENT

Figure 1:
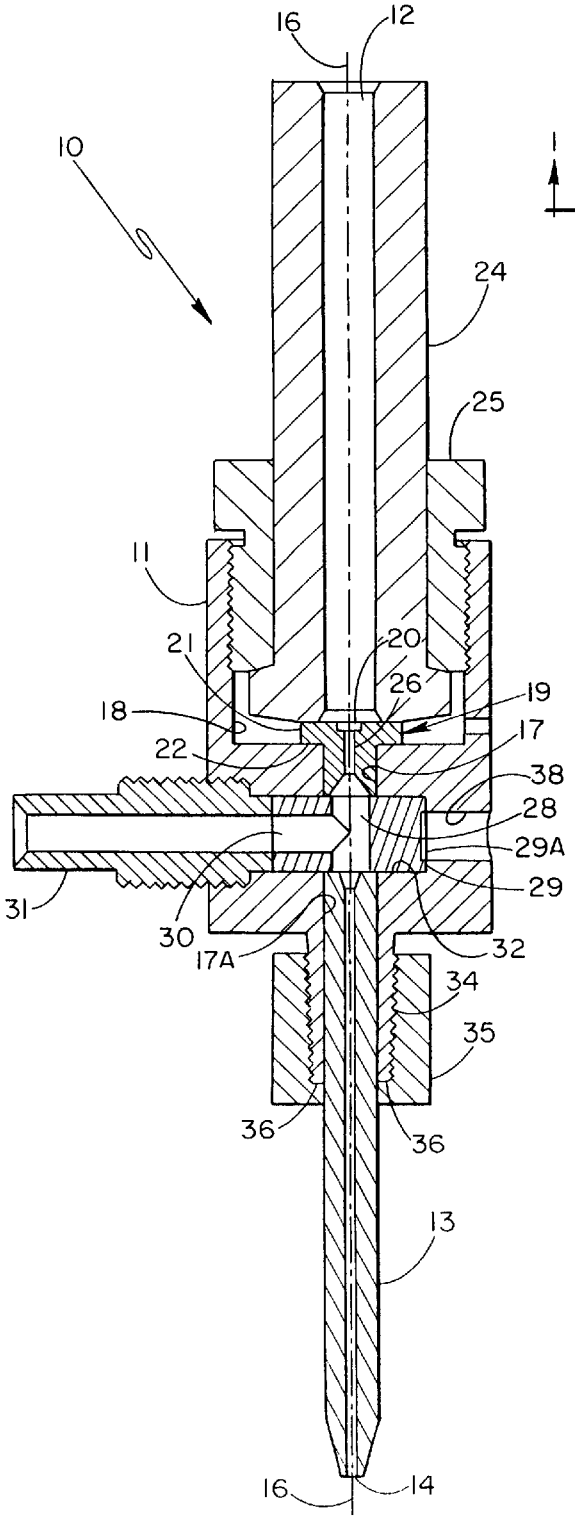
FIG. 1 is a sectional view of the water jet cutting head of the present invention, and being taken along the line 1—1 of FIG. 2.
Figure 2:
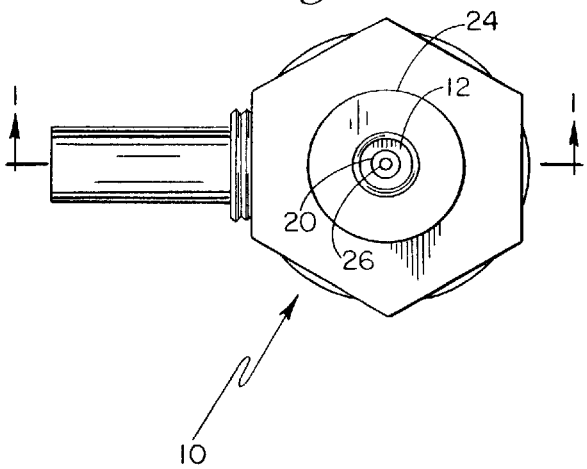
FIG. 2 is a top plan view of the water jet cutting head of the present invention.
Figure 3:
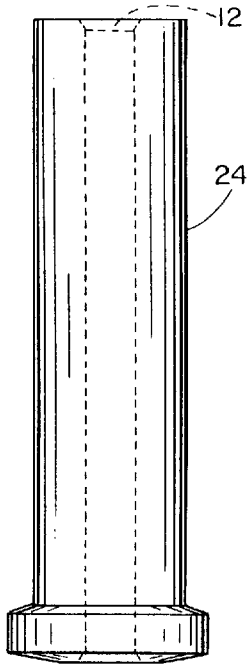
FIG. 3 is a detail sectional view of the inlet adaptor of the present invention.

In accordance with the preferred embodiment of the present invention, and with particular attention being directed to FIGS. 1 and 2, the water jet cutting head generally designated 10 includes a body member 11 with the assembly having an inlet formed as at 12, and a nozzle component 13 with an outlet 14. The entire assembly is arranged along a common axis, with the axis being shown at 16, and with each of the components along the flow path being positioned appropriately in axially aligned relationship with an internal bore, such as bore 17. It will be noted that axis 16 extends continuously through the components forming the assembly of the cutting head 10, and further that a counterbore is formed within body 11 as at 18. Counterbore 18 is, of course, in axial alignment with axis 16.

A jeweled seat assembly is shown at 19, with the jeweled seat assembly further having a cavity formed therewithin to receive jeweled orifice 20. A jewel having an orifice therethrough is referred to herein as a "jeweled orifice". Jeweled seat assembly 19 is formed with a head portion 21 having an undersurface 22 in mating relationship with the surface forming the base of counterbore 18.

Figure 4:
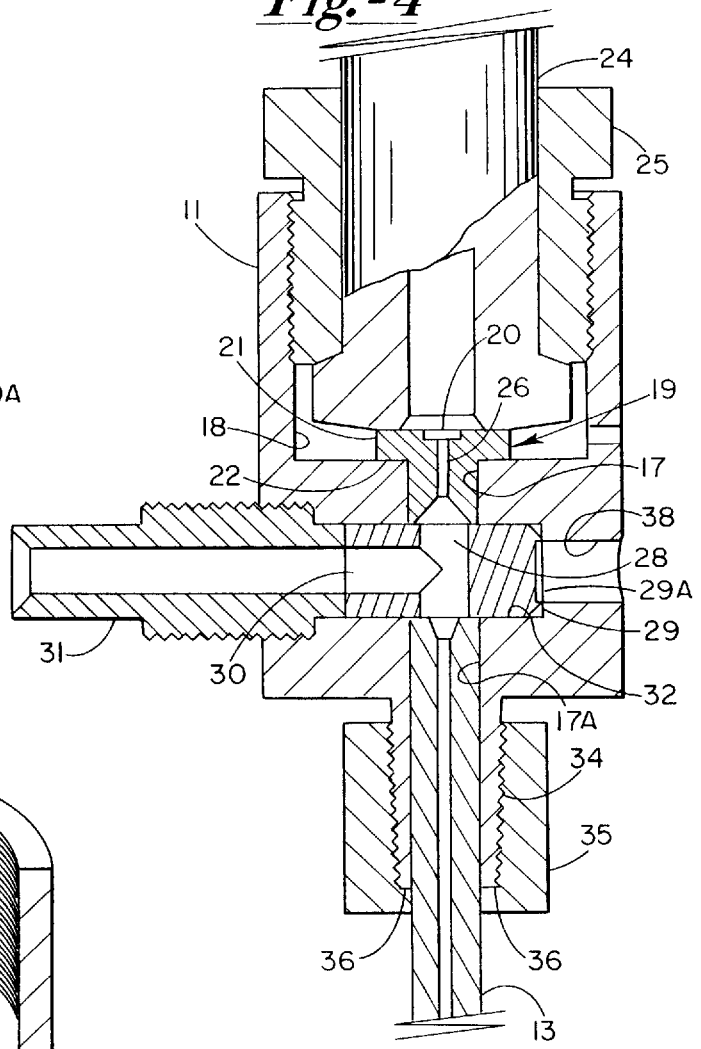
FIG. 4 is an enlarged sectional view of the jeweled seat assembly employed in connection with the present invention.
Figure 5:
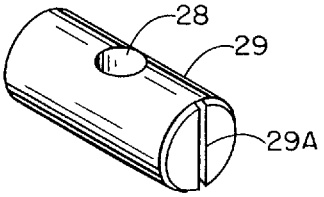
FIG. 5 is a perspective view of the insert component forming the mixing chamber of the cutting head of the present invention.
Figure 6:
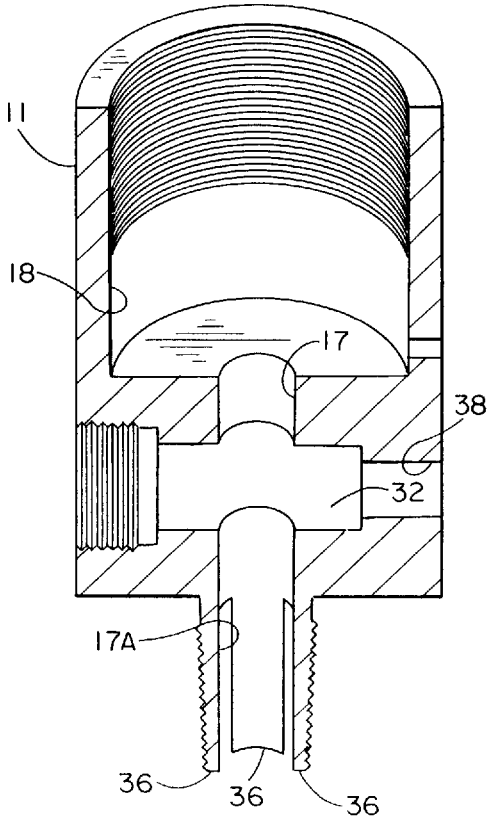
FIG. 6 is a detail sectional view, on a slightly enlarged scale and partially cut away, and illustrating that portion of the body of the cutting head into which the insert comprising the mixing chamber is placed.

As is apparent, jeweled seat assembly 19 (FIG. 4) is arranged coaxially within body 11, with seat assembly 19 being held in place by the forward end of head of adaptor 24, with gland nut 25 being utilized to sealingly force and retain jeweled orifice assembly 19 in body 11.

Bore 17 is continuous and passes through body 11, and the cylindrical portion of jeweled orifice assembly 19 is received within a segment of this bore. Jeweled seat assembly 19 is further provided with an internal bore 26 which forms, along with jewel orifice 20, a portion of the flow path which extends entirely through the member 10.

A mixing chamber is formed within the assembly as at 28, with the mixing chamber being, in turn, formed within cylindrical insert 29. Cylindrical insert 29 has a "T"-shaped bore 30 formed therewithin including a base segment along the axis of insert 29 and a cross segment extending transversely thereof. The intersection between the leg segment and cross segment, in turn, defines the zone of mixing chamber 28. Inlet nut 31 is threadably engaged in body 11 and is utilized to apply retention force against insert 29 for retention within the bore 32 formed in body 11.

Nozzle 13 is retained within collet segment 34 of body 11. Collet segment 34 is provided with threads to receive lock nut 35 thereon to function as a collet retainer. Nozzle 13 is accordingly maintained within the bore extension of body 11 as at 17A.

In order to threadably couple lock nut 35 onto the base or distal end of body 11, particularly at and about the segments 36 forming collet 34, lock nut or collet retainer 35 along with the outer surface of the segments 36 forming collet 34 are equipped with N.P.T. threads. This arrangement, and the mating conical configuration of the male and female portions forming the joint ensure that nozzle 13 is effectively retained coaxially within bore 17A of body 11.

In forming the bore 17 including its portion 17A, a single through-hole is bored within body 11 in a single operation. Thus, any deflection or misalignment is effectively eliminated. The result is a "zero" tolerance arrangement with the assembly winding up in axially aligned relationship upon completion of the assembly.

As has been indicated, mixing chamber 28 is formed within insert 29. Insert 29 is provided with an orientation indicating slot as at 29A. This slot is formed externally and visible to the technician through cross-bore 38 extending through body 11. Thus, during assembly, appropriate alignment is achieved for insert 29 within body 11, with retention being obtained, as previously indicated, by threadably engaging inlet nut retainer 31 within body 11. Suitable means, as are known in the art, are utilized to couple inlet nut 31 to an appropriate source of abrasive particulate. This arrangement has been found to provide enhanced vacuum for control of abrasive feed rates, as well as reduction of turbulence and wear within the mixing chamber.

As has been indicated, a flow channel is provided through the longitudinal extent of body 11. The orifice of jeweled orifice 20 has a diameter which is appropriate for diameters of the flow formed therefrom. By way of example, the following relationship of orifice diameter to flow and nozzle diameters are recommended:

| Orifice | Flow/Nozzle |
|---|---|
| .008 | .020 |
| .010 | .030 |
| .015 | .045 |

In this connection, therefore, the devices are generally provided with a ratio of diameters from orifice to flow channel of about 2.5:1 to 3:1.

The seals created between mating surfaces of the components are such that tendencies for galling are effectively eliminated, thus facilitating both initial assembly and subsequent disassembly for purposes of servicing the head.

It will be appreciated of course that various modifications may be made to the specific structure set forth hereinabove without departing from the spirit and scope of the invention.

What is claimed is:

1. A cutting head for a water jet cutting assembly comprising, in combination:

(a) an elongated body having a central axis, a main bore coaxial with said central axis, a counterbore having a flat annular surface at the base thereof, an inlet adjacent said counterbore along with an outlet disposed in opposed relationship to said inlet, and a mixing chamber interposed between said inlet and outlet;

(b) a jeweled orifice assembly including a mounting shoulder mounted upon said flat annular surface, said jeweled orifice assembly comprising a cylindrical body with a flanged head and a jewel receiving cavity within said flanged head and positioned coaxially with said main bore for mounting a jeweled orifice adjacent said inlet, a flow channel formed within said jeweled orifice assembly and extending from said assembly toward said outlet and arranged coaxially with said main bore;

(c) the flanged head of said jeweled orifice assembly having an undersurface in planar mating relationship with said flat annular surface;

(d) an inlet adaptor positioned coaxially within said counterbore and having a flanged forward head disposed in opposed relationship to said jeweled orifice assembly and with the said flanged forward head having a planar surface in mating contact with the outer surface of the flanged head of said jeweled orifice assembly;

(e) the bore within said body adjacent said outlet having a nozzle member retained therewithin, the nozzle member having a bore formed concentrically therethrough for receiving a flow of water from the bore of said jeweled orifice assembly, and means for retaining said nozzle member coaxially within said main bore, said retaining means including mating conically configured threaded surfaces.

2. The cutting head for a water jet cutting assembly as defined in claim 1 being particularly characterized in that a mixing chamber is positioned within said body, said mixing chamber being enclosed within a cylindrical insert member having a "T" bore formed therewithin, and with the mixing chamber being disposed adjacent the intersection of the leg and cross bore segments of said "T", and with the leg segment of said "T" bore being adapted to receive a charge of abrasive for introduction into said mixing chamber.

3. The cutting head for a water jet cutting assembly as defined in claim 2 being particularly characterized in that means are provided for orienting the position of said cross bore segment within said body.

4. The cutting head for a water jet cutting assembly as defined in claim 1 being particularly characterized in that means are provided for forcibly retaining said jeweled orifice assembly against the surface of said adaptor to form a seal zone between mating surfaces of said jeweled orifice assembly and said inlet adaptor and between the mating surfaces of the jeweled orifice assembly and said cross bore segment.

5. The cutting head for a water jet cutting assembly as defined in claim 1 being particularly characterized in that the outlet of said body is disposed along a conically shaped distal tip portion of said body.

* * * * *